US007881649B2

(12) United States Patent
Van Bortel et al.

(10) Patent No.: US 7,881,649 B2
(45) Date of Patent: Feb. 1, 2011

(54) LIQUID SUPPLY SYSTEMS, FUSERS AND METHODS OF SUPPLYING LIQUIDS IN PRINTING APPARATUSES

(75) Inventors: David P. Van Bortel, Victor, NY (US); Brendan H. Williamson, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 323 days.

(21) Appl. No.: 12/212,139

(22) Filed: Sep. 17, 2008

(65) Prior Publication Data

US 2010/0067962 A1 Mar. 18, 2010

(51) Int. Cl.
*G03G 15/20* (2006.01)

(52) U.S. Cl. ..... 399/325

(58) Field of Classification Search ..... 399/324–326
See application file for complete search history.

(56) References Cited

U.S. PATENT DOCUMENTS

| | | | | |
|---|---|---|---|---|
| 4,214,549 | A | 7/1980 | Moser | |
| 4,397,936 | A * | 8/1983 | Sakata et al. | 399/324 |
| 5,043,768 | A * | 8/1991 | Baruch | 399/325 |
| 5,221,948 | A * | 6/1993 | Dalal | 399/325 |
| 6,029,040 | A * | 2/2000 | Yamada et al. | 399/325 |
| 6,190,771 | B1 | 2/2001 | Chen et al. | |
| 6,360,072 | B1 * | 3/2002 | Costrop et al. | 399/325 |
| 6,795,677 | B2 | 9/2004 | Berkes et al. | |
| 7,046,948 | B1 * | 5/2006 | Zess et al. | 399/325 |
| 7,155,154 | B2 | 12/2006 | Uehara et al. | |
| 7,296,882 | B2 | 11/2007 | Buehler et al. | |
| 7,319,838 | B2 | 1/2008 | Baba et al. | |

(Continued)

FOREIGN PATENT DOCUMENTS

| | | | |
|---|---|---|---|
| JP | 08137316 A | * | 5/1996 |
| JP | 2004272125 A | * | 9/2004 |

OTHER PUBLICATIONS

Patricia Lai et al.; The Relationship Between Paper Properties and Fuser Oil Uptake in High-Speed Digital Xerographic Printing; Journal of Imaging Science and Technologyl 2007 vol. 51, No. 5, pp. 424-430.

*Primary Examiner*—Susan S Lee
(74) *Attorney, Agent, or Firm*—Ronald E. Prass, Jr.; Prass LLP

(57) ABSTRACT

Liquid supply systems, fusers and methods of supplying liquids in printing apparatuses are disclosed. An exemplary embodiment of a liquid supply system for supplying liquid to a fusing surface of a fuser member, comprises a metering roll having a first outer surface; a donor roll having a second outer surface disposed adjacent the first outer surface to define a first nip between the first and second outer surfaces; and a liquid reducing roll having a third outer surface adapted to be disposed adjacent the second outer surface to define a second nip between the second and third outer surfaces. The metering roll is adapted to convey the liquid from the first outer surface to the second outer surface. The donor roll is adapted to be disposed adjacent the fuser member such that the second outer surface and the fusing surface define a third nip, and to convey the liquid from the second outer surface to the fusing surface. The liquid reducing roll is adapted to remove a portion of the liquid from the second outer surface before the liquid is conveyed to the fusing surface.

13 Claims, 6 Drawing Sheets

U.S. PATENT DOCUMENTS

2005/0015987 A1 1/2005 Berg
2006/0239728 A1 10/2006 Van Bortel
2006/0292360 A1* 12/2006 Hays et al.
2007/0116499 A1* 5/2007 Derimiggio et al.
2008/0037069 A1 2/2008 Mestha et al.
2010/0066792 A1* 3/2010 Williamson et al.
2010/0067963 A1* 3/2010 Williamson et al. ..... 399/325

* cited by examiner

LIQUID SUPPLY SYSTEMS, FUSERS AND METHODS OF SUPPLYING LIQUIDS IN PRINTING APPARATUSES

RELATED APPLICATIONS

This application is related to the application entitled "APPARATUS AND METHOD FOR METERING FLUID FILM IN AN IMAGE FUSING SYSTEM," Ser. No. 12/212,201 and the application entitled "APPARATUS AND METHOD FOR METERING FLUID FILM IN AN INK JET PRINTING SYSTEM," Ser. No. 12/212,230, each of which is filed on the same date as the present application, commonly assigned to the assignee of the present application, and incorporated herein by reference in its entirety.

BACKGROUND

Liquid supply systems, fusers and methods of supplying liquids in printing apparatuses are disclosed.

In some printing processes, toner images are formed on media, and the toner is then heated to fuse the toner onto the media. One process used for thermal fusing toner onto media uses a fuser including a nip between a fuser member and a pressure roll. During operation, a medium with a toner image is fed to the nip, and heat and pressure are applied to the medium by the fuser member and pressure roll to fuse the toner.

In such printing apparatuses, liquid release agents can be supplied to the fuser member by a liquid delivery system. The release agent is used to promote release of toner and media from the fuser member to extend its service life. It would be desirable to provide printing apparatuses that allow more controllable application of such release agents to fuser members.

SUMMARY

According to aspects of the embodiments, liquid supply systems, fusers and methods of supplying liquids in printing apparatuses are disclosed. An exemplary embodiment of a liquid supply system for supplying liquid to a fusing surface of a fuser member, comprises a metering roll having a first outer surface; a donor roll having a second outer surface disposed adjacent the first outer surface to define a first nip between the first and second outer surfaces; and a liquid reducing roll having a third outer surface adapted to be disposed adjacent the second outer surface to define a second nip between the second and third outer surfaces. The metering roll is adapted to convey the liquid from the first outer surface to the second outer surface. The donor roll is adapted to be disposed adjacent the fuser member such that the second outer surface and the fusing surface define a third nip, and to convey the liquid from the second outer surface to the fusing surface. The liquid reducing roll is adapted to remove a portion of the liquid from the second outer surface before the liquid is conveyed to the fusing surface.

DRAWINGS

DETAILED DESCRIPTION

The disclosed embodiments include a liquid supply system for supplying liquid to a fusing surface of a fuser member, which comprises a metering roll having a first outer surface; a donor roll having a second outer surface disposed adjacent the first outer surface to define a first nip between the first and second outer surfaces; and a liquid reducing roll having a third outer surface adapted to be disposed adjacent the second outer surface to define a second nip between the second and third outer surfaces. The metering roll is adapted to convey the liquid from the first outer surface to the second outer surface. The donor roll is adapted to be disposed adjacent the fuser member such that the second outer surface and the fusing surface define a third nip, and to convey the liquid from the second outer surface to the fusing surface. The liquid reducing roll is adapted to remove a portion of the liquid from the second outer surface before the liquid is conveyed to the fusing surface.

The disclosed embodiments further include a fuser comprising a metering roll having a first outer surface; a sump containing a supply of a liquid, the first outer surface being adapted to contact the liquid in the sump; a donor roll having a second outer surface disposed adjacent the first outer surface to define a first nip between the first and second outer surfaces; a liquid reducing roll having a third outer surface adapted to be disposed adjacent the second outer surface to define a second nip between the second and third outer surfaces; a fuser member having a fusing surface disposed adjacent the second outer surface to define a third nip between the second outer surface and the fusing surface; and a pressure roll having a fourth outer surface disposed adjacent the fusing surface to define a fourth nip between the fusing surface and the fourth outer surface. The metering roll is adapted to convey the liquid from the first outer surface to the second outer surface. The donor roll is adapted to convey the liquid from the second outer surface to the fusing surface. The liquid reducing roll is adapted to remove a portion of the liquid from the second outer surface before the liquid is conveyed to the fusing surface.

The disclosed embodiments further include a method of supplying liquid to a fusing surface of a fusing member, which comprises conveying the liquid from the first surface of a metering roll to a second surface of a donor roll adjacent the first surface; conveying the liquid from the second surface to the fusing surface of the fuser member adjacent the second surface; and removing a portion of the liquid from the second outer surface with a liquid reducing roll having a third outer surface adjacent the second outer surface before the liquid is conveyed to the fusing surface.

Figure 1:
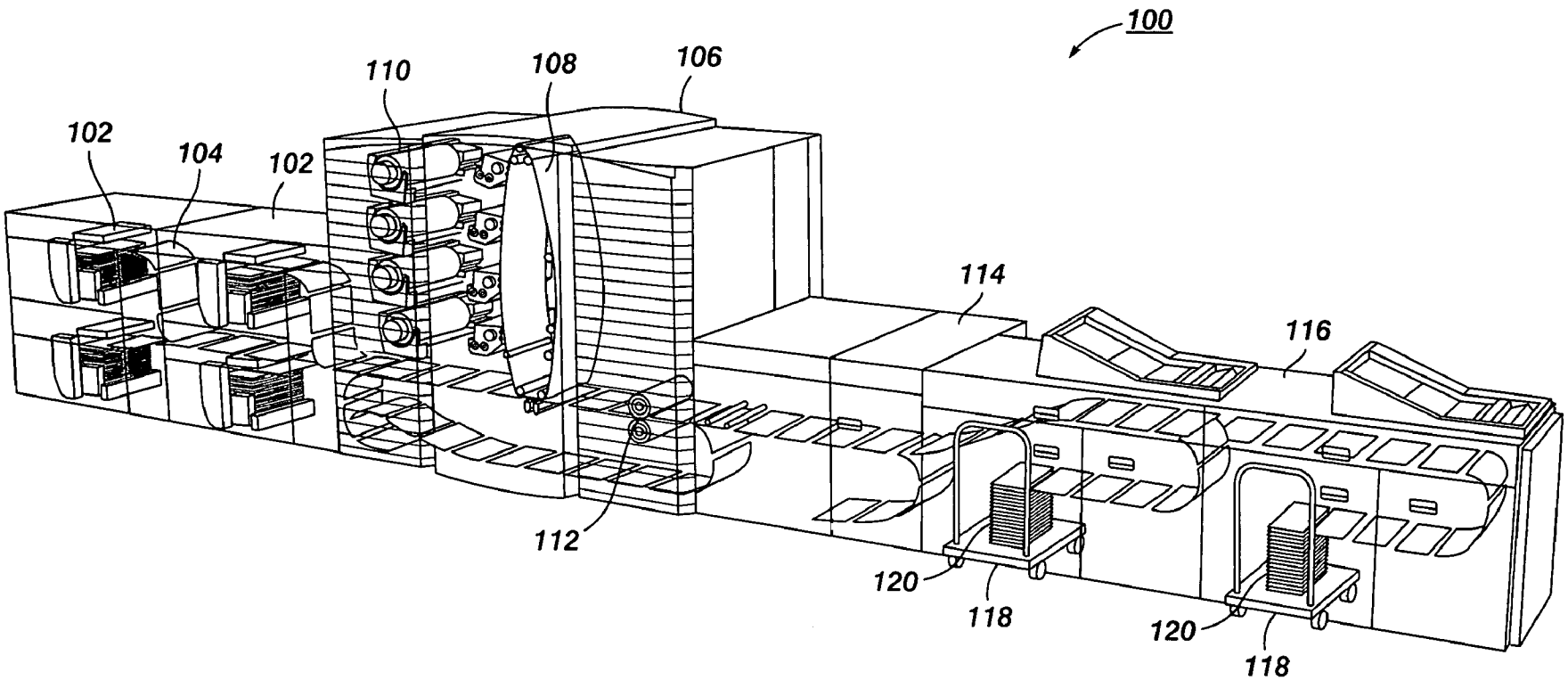
FIG. 1 illustrates an exemplary embodiment of a printing apparatus.

FIG. 1 illustrates an exemplary printing apparatus 100, such as disclosed in U.S. Patent Application Publication No. 2008/0037069, which is incorporated herein by reference in its entirety. As used herein, the term "printing apparatus" encompasses any apparatus, such as a digital copier, bookmaking machine, multifunction machine, and the like, that performs a print outputting function for any purpose. The printing apparatus 100 can be used to produce prints from various types of media, such as coated or uncoated (plain) paper sheets, at high speeds. The media can have various sizes and weights. In embodiments, the printing apparatus 100 has a modular construction. As shown, the apparatus includes two media feeder modules 102 arranged in series, a printer module 106 adjacent the media feeding modules 102, an inverter module 114 adjacent the printer module 106, and two stacker modules 116 arranged in series adjacent the inverter module 114.

In the printing apparatus 100, the media feeder modules 102 are adapted to feed media having various sizes (widths and lengths) and weights to the printer module 106. In the printer module 106, toner is transferred from a series of developer stations 110 to a charged photoreceptor belt 108 to form toner images on the photoreceptor belt and produce color prints. The toner images are transferred to one side of respective media 104 fed through the paper path. The media are advanced through a fuser 112 adapted to fuse the toner images on the media. The inverter module 114 manipulates media exiting the printer module 106 by either passing the media through to the stacker modules 116, or inverting and returning the media to the printer module 106. In the stacker modules 116, the printed media are loaded onto stacker carts 118 to form stacks 120.

Figure 2:
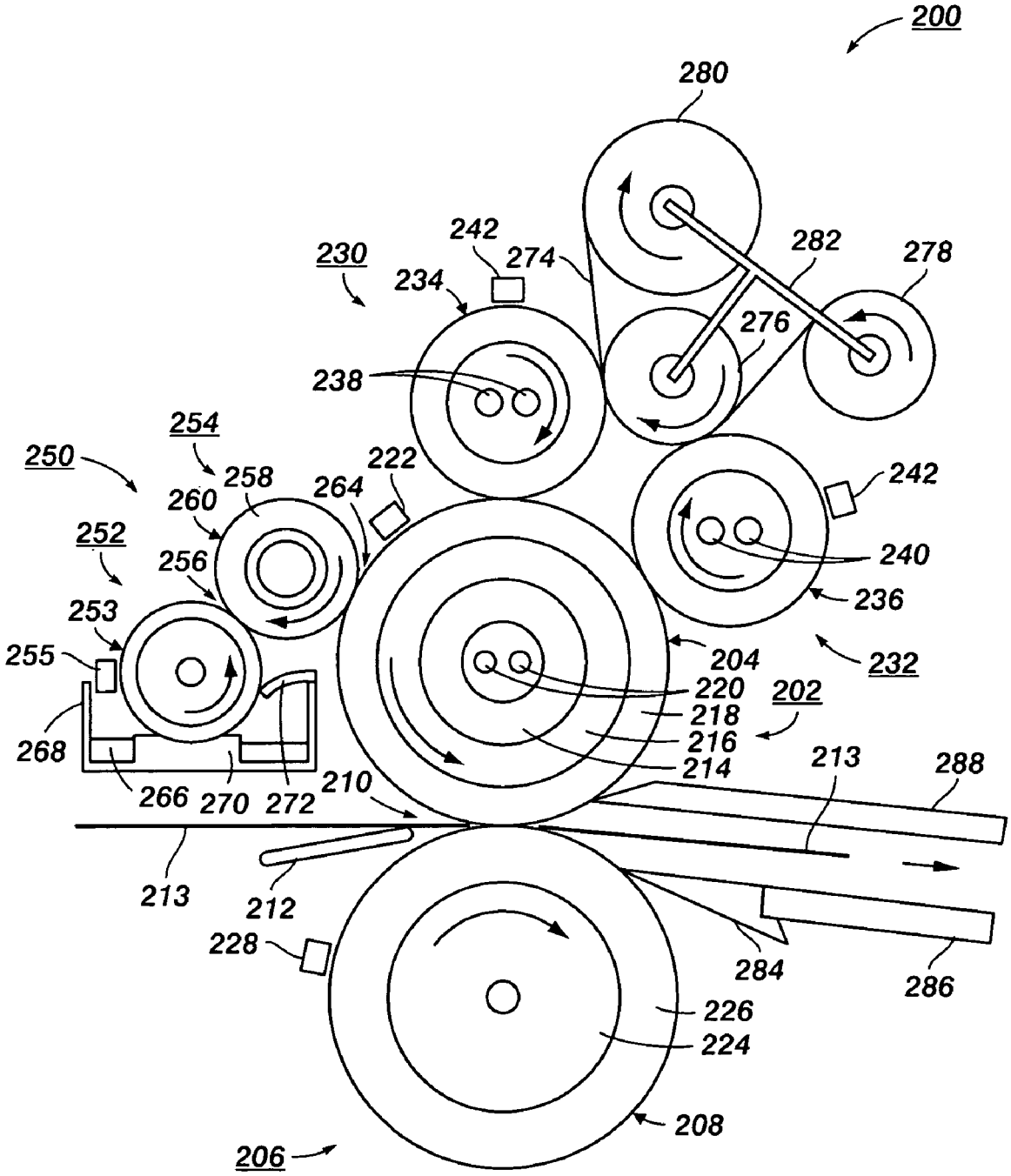
FIG. 2 illustrates an embodiment of a fuser including a liquid supply system.

FIG. 2 illustrates an exemplary embodiment of a fuser 200 in which embodiments of the disclosed liquid supply system can be used. As shown, the fuser 200 includes a fuser roll 202 having a fusing surface 204, a pressure roll 206 having an outer surface 208, and a nip 210 between the fusing surface 204 and the outer surface 208. In embodiments, the fuser roll 202 is driven by a drive mechanism and the pressure roll 206 is connected to a cam. The fuser roll 202 and pressure roll 206 rotate in opposite directions, as shown. A guide 212 is positioned to direct media carrying toner images on at least face into the nip 210 where the fuser roll 202 and pressure roll 206 apply heat and pressure to the media and toner to fuse the toner images on the media.

In embodiments, the fuser roll 202 includes a hollow core 214, an inner layer 216 overlying the core 214, and an outer layer 218 overlying the inner layer 216. In embodiments, the core 214 is comprised of aluminum, or the like; the inner layer 216 is comprised of an elastomeric material, such as silicone, or the like; and the outer layer 218 is comprised of a fluoroelastomer sold under the trademark Viton® by DuPont Performance Elastomers, L.L.C., or the like. The outer layer 218 includes the fusing surface 204.

Heating elements 220 are located inside the core 214. In embodiments, the heating elements 220 are lamps, such as tungsten-quartz lamps, which extend axially along the fuser roll 202. The lamps can have the same or different axial lengths. The heating elements 220 are connected to a power supply (not shown). Two thermistor/thermostats 222 (only one is shown) are positioned at axially-spaced locations along the fusing surface 204.

In embodiments, the pressure roll 206 includes a core 224, and an outer layer 226 overlying the core 224. In embodiments, the core 224 is of aluminum or the like, and the outer layer 226 is comprised of a perfluoroalkoxy (PFA) copolymer resin or the like. At least one thermistor/thermostat 228 is positioned adjacent the outer surface 208.

The fuser 200 includes external heating rolls 230, 232 having outer surfaces 234, 236, respectively. In embodiments, the heating rolls 230, 232 are comprised of anodized aluminum. As shown, the heating rolls 230, 232 rotate in the same direction. In embodiments, the heating rolls 230, 232 are connected to cams and have fixed centers. The outer surfaces 234, 236 contact the fusing surface 204 of the fuser roll 202. Heating elements 238, 240 are located inside of the heating rolls 230, 232, respectively. In embodiments, the heating elements 238, 240 are lamps, such as tungsten-quartz lamps, which extend axially along these heating rolls. The lamps can have the same or different axial lengths. The heating elements 238, 240 are connected to a power supply (not shown). At least one thermistor/thermostat 242 is positioned adjacent each of the outer surfaces 234, 236. The heating rolls 230, 232 are adapted to heat the fusing surface 204 after it has contacted a medium at the nip 210.

A liquid supply system 250 is positioned adjacent the fuser roll 202. The liquid supply system 250 is adapted to supply a liquid release agent to the fusing surface 204. The liquid supply system 250 includes a metering roll 252 and a donor roll 254 defining a nip 256. The metering roll 252 includes an outer surface 253. The metering roll 252 is typically comprised of a hard material, such as steel. A thermistor/thermostat 255 is positioned adjacent the outer surface 253. In embodiments, the donor roll 254 includes an inner layer 258, and an outer layer having an outer surface 260 on the inner layer 258. The inner layer 258 can be comprised of silicone, or the like. The outer layer is comprised of an elastomeric material, such as Viton®, or the like. The donor roll 254 and the fusing surface 204 define a nip 264.

The metering roll 252 is in contact with a supply of a liquid release agent 266 contained in a sump 268. A wick 270 is provided in the sump 268. The metering roll 252 and donor roll 254 rotate in opposite directions, as shown, to convey the release agent 266 from the sump 268 to the metering roll 252, from the metering roll 252 to the donor roll 254 at nip 256, and from the donor roll 254 to the fusing surface 204 at nip 264.

A resiliently-biased metering blade 272 is positioned in contact with the hard outer surface 253 of the metering roll 252 to meter the release agent to the donor roll 254. The metering blade 272 controls the quantity and uniformity of the release agent on the outer surface 253 of the metering roll 252. The metering blade can be comprised, e.g., of Viton® or the like.

The release agent is supplied to the fusing surface 204 of the fuser roll 202 to promote release of toner and media from the fusing surface 204, in order to extend the service life of the fuser roll 202. The release agent can be selected, e.g., from silicon-based organic polymers, such as polydimethylsiloxane (PDMS), or the like.

The fuser 200 further includes a cleaning web 274 supported on a web nip roll 276. In embodiments, the web nip roll 276 is comprised of a silicone foam material. The web nip roll 276 is connected to a web supply roll 278 and a web take-up roll 280 by a frame 282. The cleaning web 274 is unwound from the web supply roll 278 and taken-up on the driven web take-up roll 280 as these rolls rotate, as shown. The cleaning web 274 cleans the outer surfaces of the heating rolls 234, 236.

As shown, the fuser further includes a stripper finger 284 and a baffle 286, and an air knife 288, for separating media carrying toner and release agent from the fusing surface 204 after fusing.

In the fuser 200, the release agent 266 is transferred from the fusing surface 204 to the top face of media that are passed through nip 210 between the fusing surface 204 and the surface 208 of pressure roll 206. It is desirable to minimize the amount of release agent that is transferred from the fusing surface 204 to minimize contamination of such media.

In the liquid supply system 250, the amount of release agent on the hard outer surface 253 of the metering roll 252 is controlled by the metering blade 272. Such blades can, however, have edge quality problems, making the liquid supply system 250 susceptible to producing streaks of high levels and/or of low levels of release agent.

In printing apparatuses, to minimize the amount of release agent that is transferred from the fusing surface of a fuser member to media, it is desirable to supply an amount of release agent to the fusing surface that is close to the minimum amount effective to promote release of media and toner from the fusing surface. The ability to apply lower release agent levels broadens the scope of applications that printing apparatuses can be used to perform. However, when such printing apparatuses are run at overly-low levels of release agent application, dry streaks and dirt problems can be exacerbated.

On the other end of the spectrum, some media may need higher levels of release agent to be placed on them in order to provide acceptable fuser roll service life and performance. However, applying an overly-high level of release agent to media can be deleterious in regard to achieving good performance for various post-printing operations, including hot-melt adhesive application for book binding, laminating hot and cold films, mailing tabs and labels, pressure seal applications, and the like.

Figure 3:
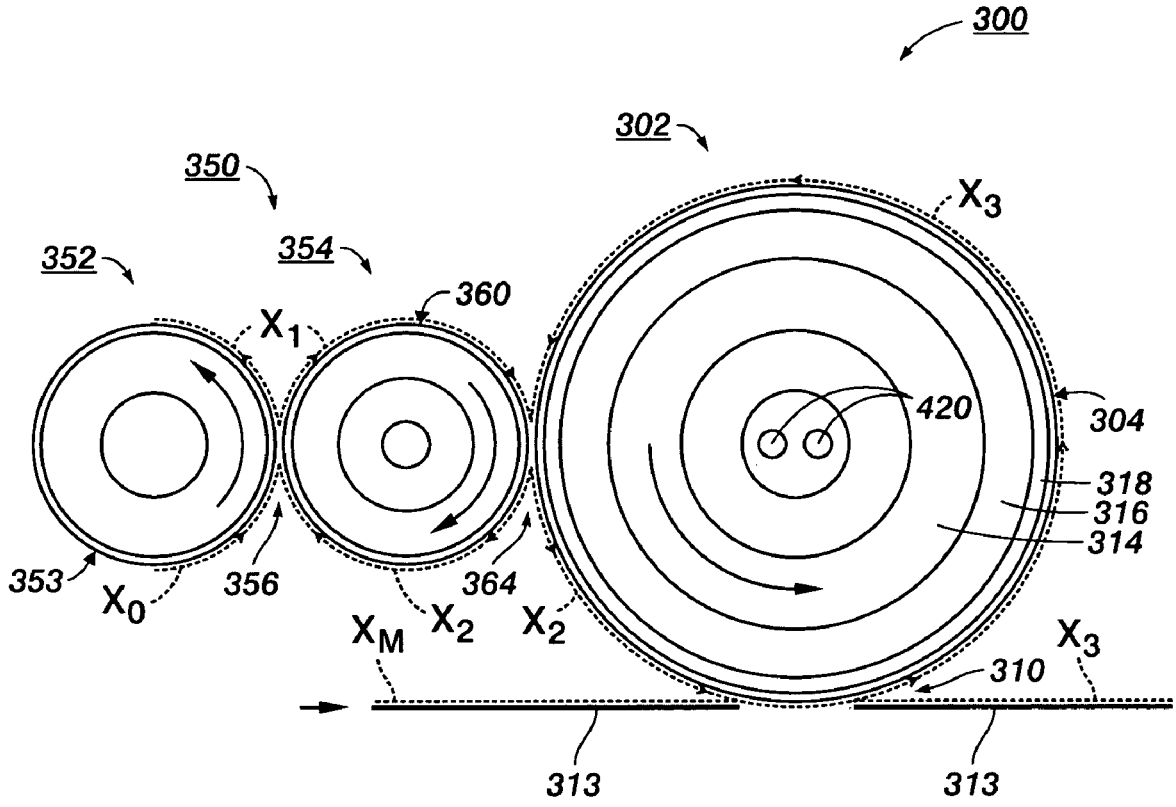
FIG. 3 illustrates liquid transfer from a liquid supply system to a fuser member.

FIG. 3 illustrates a liquid supply system 350 for supplying liquid to a fusing surface 304 of a fuser roll 302 in a fuser 300. The liquid supply system 350 includes a roll arrangement with a metering roll 352 having an outer surface 353, and a donor roll 354 including an outer layer having an outer surface 360, such as in the liquid supply system 200 shown in FIG. 2. For simplicity, a pressure roll positioned adjacent the fuser roll 302, a sump containing a supply of a liquid release agent in contact with the metering roll 352, and a metering blade in contact with the outer surface 353 of the metering roll 352 are not shown in FIG. 3. The metering roll 352 and donor roll 354 define a nip 356, and the donor roll 354 and fuser roll 302 define a nip 364. The fuser roll 302 and pressure roll define a nip 310.

In FIG. 3, lines $X_0$, $X_1$, $X_2$ and $X_3$ represent amounts of liquid (e.g., release agent) carried on the metering roll 352, donor roll 354 and fuser roll 302. In FIG. 3, the following assumptions are made regarding liquid transfer: 50/50 split of liquid at each nip exit; and no loss of release agent to the heating rolls 230, 232, pressure roll, or web 274. As shown, an amount of liquid $X_0$ is carried on the outer surface 353 of metering roll 352 after passing the metering blade. At the nip 356, the amount $X_0$ is split, resulting in an amount of liquid $X_1$ being carried on both the outer surface 360 of the donor roll 354 and the outer surface 353 of the metering roll 352 after nip 356. At the nip 364, the amount $X_1$ carried on the outer surface 360 is split, resulting in an amount of liquid $X_2$ being carried on both the fusing surface 304 of the fuser roll 302 and the outer surface 360 of the donor roll 354 after nip 364. At the nip 310 between the fusing surface 304 and the pressure roll, the amount $X_2$ carried on the fusing surface 304 is split, resulting in an amount of liquid $X_3$ being carried on both the medium and the fusing surface 304 after nip 310.

Based on the assumptions for oil splitting and oil loss in the liquid supply system 350, for the inside paper path (IPP) of the rolls, $X_1$, $X_2$ and $X_3$ have the following values with respect to $X_0$:

$$X_1=\tfrac{3}{4}X_0, \tag{1}$$

$$X_2=\tfrac{1}{2}X_0, \tag{2}$$

$$X_3=\tfrac{1}{4}X_0. \tag{3}$$

$X_M=0$ (where $X_M$ is the amount of liquid on the medium arriving at nip 310). (4)

Figure 4:
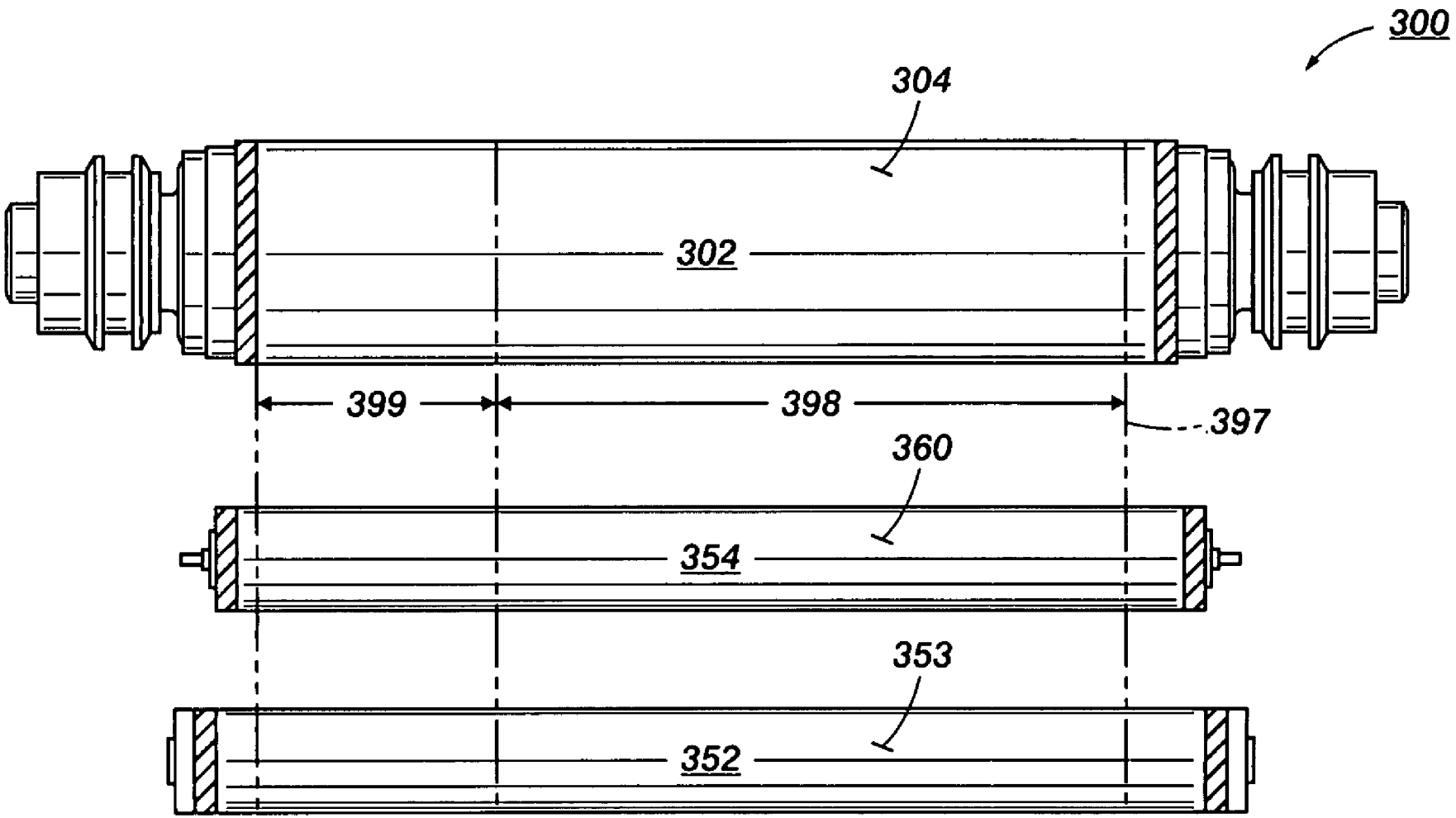
FIG. 4 is a bottom view of the liquid supply system and fuser member shown in FIG. 3

FIG. 4 shows a bottom view of the metering roll 352, donor roll 354 and fuser roll 302 of the liquid supply system 350 shown in FIG. 3. In FIG. 4, the location of a paper registration edge 397, the inside paper path length 398 (which corresponds to the width of a medium registered at the paper registration edge 397), and the outside paper path length 399 are indicated. The inside paper path portion of the fusing surface 304 is contacted by media registered at the paper registration edge 397, while the outside paper path portion of the fusing surface 304 is not contacted by media. The inside paper path length 398 and the outside paper path length 399 vary together depending on the width of media fed to the fuser.

Based on the assumptions made for oil splitting and oil loss in the liquid supply system 350, for the outside paper path (OPP), $X_1$, $X_2$, $X_3$ and $X_M$ have the following values (where $X_0$ is the amount of oil carried on the outer surface 353 of the metering roll 352 after passing the metering blade):

$$X_1=X_0, \tag{5}$$

$$X_2=X_0, \tag{6}$$

$$X_3=X_0, \text{ and} \tag{7}$$

$$X_M=0 \tag{8}$$

Comparing equations (3) and (7), the ratio, $R_{OPP/IPP}$, of the amount of liquid on the fusing surface 304 (and placed on media) for the outside paper path to that of the inside paper path after passing the nip 310 is equal to four.

Figure 5:
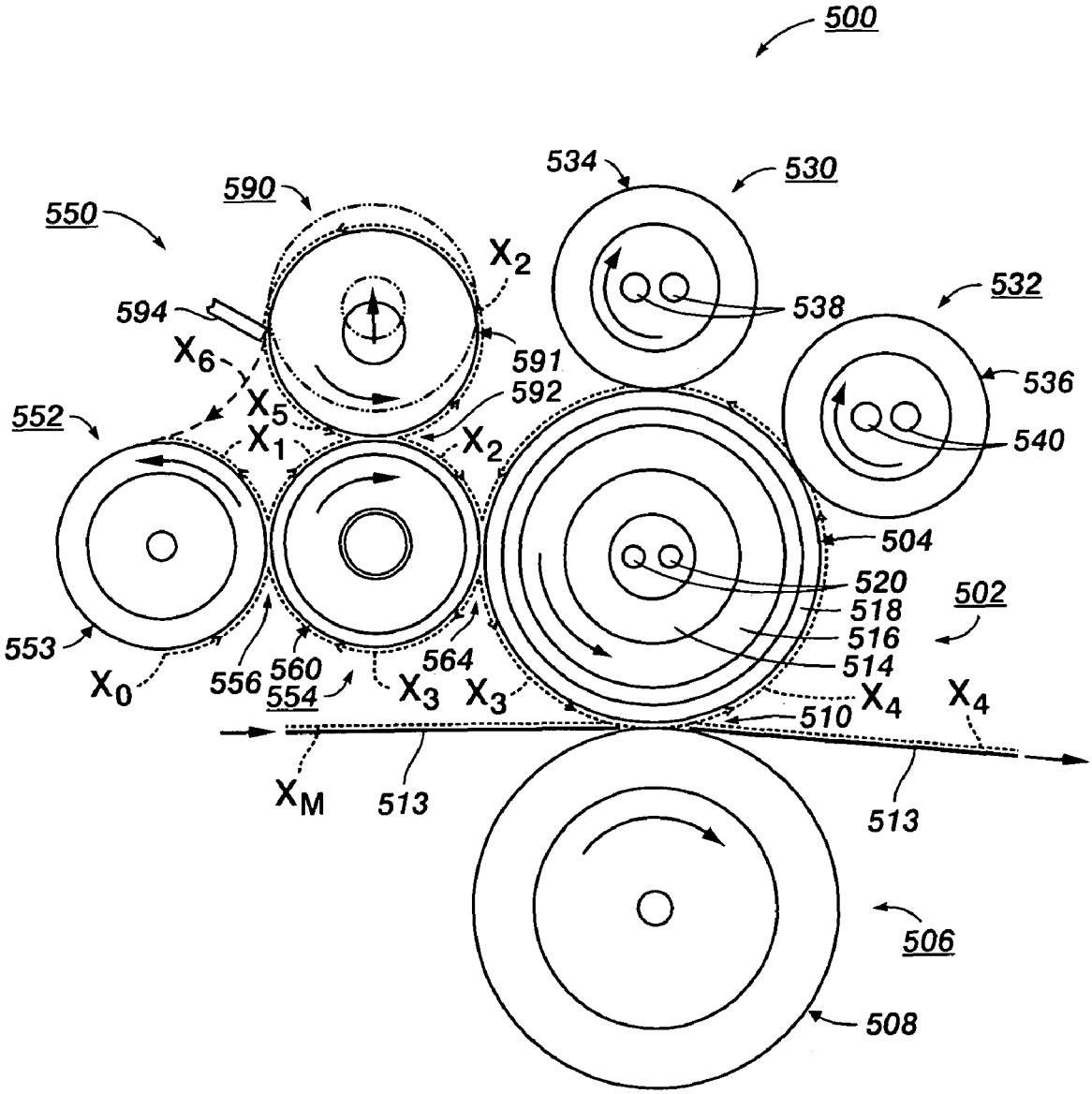
FIG. 5 illustrates liquid transfer from an exemplary embodiment of a liquid supply system including a liquid reducing roll to a fuser member.

FIG. 5 illustrates an exemplary embodiment of a liquid supply system 550 for supplying liquid to a fusing surface 504 of a fuser roll 502 of a fuser 500. The liquid supply system 550 includes a metering roll 552 having an outer surface 553, and a donor roll 554 including an outer layer having an outer surface 560. In embodiments, the metering roll 552, donor roll 554 and fuser roll 502 can have the same construction as the metering roll 252, donor roll 254 and fuser roll 202, for example. In embodiments, the fuser 500 includes a sump containing a supply of a liquid release agent (not shown). The release agent is picked up by the metering roll 552. The sump can have the configuration of sump 268 shown in FIG. 2, for example.

The metering roll 552 and donor roll 554 define a nip 556, and the donor roll 554 and fuser roll 502 define a nip 564. In the illustrated roll configuration, the axes of the metering roll 552 and donor roll 554 lie in a common horizontal plane. In other embodiments of the liquid supply system 550, depending on the fuser configuration and size constraints in the printing apparatus, the axis of the donor roll 554 can be located above the axis of the metering roll 552 (such as shown in FIG. 2 for the metering roll 252 and donor roll 254), or below the axis of the metering roll 552.

In the embodiment of the liquid supply system 550 shown in FIG. 5, a single liquid reducing roll 590 is positioned adjacent the donor roll 554. In other embodiments, the liquid supply system can include two or more liquid reducing rolls, depending upon the amount of reduction of release agent supply that is desired and the specific geometry and size of the liquid supply system and printing apparatus. For example, an additional liquid reducing roll and associated metering blade can be placed adjacent the outer surface 560 of donor roll 554 at a position on the outer surface 554 clockwise from the position of the liquid reducing roll 590. In such embodiments, the liquid reducing roll 590 can be re-positioned (e.g., moved counter-clockwise with respect to the outer surface 554) to accommodate the additional liquid reducing roll. In embodiments, the liquid reducing roll 590 and the additional liquid reducing roll can have the same or different dimensions as each other. For example, the outer diameters of liquid reducing roll 590 and the additional liquid reducing roll can be the same or different. In embodiments, the additional liquid reducing roll can have the same length as liquid reducing roll 590. In other embodiments, the additional liquid reducing roll can be shorter than the liquid reducing roll 590 to provide the desired liquid metering performance.

In embodiments, the liquid reducing roll 590 is connected to a cam mechanism (not shown), which is operable to selectively move the liquid reducing roll 590 in and out of engagement with the donor roll 554, by rotation and/or translation. In FIG. 5, upward movement of the liquid reducing roll 590 is depicted in phantom line. The cam mechanism can also vary the amount of pressure that the liquid reducing roll 590 applies to the outer surface 560 of the donor roll 554, which can affect liquid transfer at the nip 592.

The liquid reducing roll 590 has an outer surface 591. The outer surface 560 of the donor roll 554 and outer surface 591 of the liquid reducing roll 590 define a nip 592. In embodiments, the nip 592 defined by outer surface 591 and outer surface 560 provides an effective contact time and pressure. In embodiments, the outer surface 591 and outer surface 560 provide conformability from surface structure and roughness impacts to maximize contact area between these surfaces. In embodiments, the materials of the outer surface 591 and outer surface 560 provide effective surface energy to allow liquid wetting and promote film splitting with the donor roll 554. In embodiments, the material of outer surface 591 is resistant to wear due to contact with a metering blade 594. The outer surface 591 can be comprised of an elastomeric material, such as Viton®, silicone, or the like, that can be deformed by contact with the outer surface 560 of the donor roll 554. Such elastomeric materials can be provided on metals. In other embodiments, the outer surface 591 can be comprised of a material that is harder than such elastomeric materials, such as a metallic (e.g., steel), ceramic or hard polymeric material. Such hard materials can be used in embodiments in which the outer surface 560 of donor roll 554 is comprised of a deformable material, such as an elastomeric material.

In embodiments, the liquid reducing roll 590 can have about the same diameter as the donor roll 554, for example. The liquid reducing roll 590 can typically have about the same axial length as the donor roll 554, and the outer surface 591 can contact the outer surface 560 of the donor roll 554 along about entire length of the outer surface 591.

The fusing surface 504 and the outer surface 508 of pressure roll 506 define a nip 510. Media carrying toner images are fed to the nip by a sheet feeding device to fuse toner on the media. The liquid reducing roll 590, when positioned in contact with the donor roll 554, removes liquid from the outer surface 560 of the donor roll 554 before the portion of the outer surface 560 that the liquid has been removed from contacts the fusing surface 504. By reducing the amount of liquid on the outer surface 560 of the donor roll 554 at this point of the liquid supply process from the sump to the fusing surface 504, less liquid is ultimately placed on media by the fuser roll 502. Consequently, print defects and other undesirable effects that can be caused by supplying an excessive amount of release agent to the fusing surface 504 and media can be reduced.

In the liquid supply system 550 shown in FIG. 5, optional heating rolls 530, 532 having outer surfaces 534, 536, respectively, are positioned in contact with the fusing surface 504. In embodiments, the fuser 500 can further include an optional cleaning web for cleaning the heating rolls 530, 532. In such embodiments, the cleaning web can be supported on a web nip roll connected to a web supply roll and a web take-up roll by a frame, such as in the fuser 200 shown in FIG. 2.

As shown in FIG. 5, lines $X_0$, $X_1$, $X_2$, $X_3$, $X_4$, $X_5$ and $X_6$ represent liquid carried on the outer surfaces of the metering roll 552, donor roll 554, fuser roll 502 and liquid reducing roll 590. In FIG. 5, the following assumptions are made regarding liquid transfer between the rolls: a 50/50 split of liquid at each nip exit; and no loss of release agent to the heating rolls 530, 532, pressure roll, or optional web. As shown, an amount of liquid $X_0$ is carried on the outer surface 553 of metering roll 552 after rotating past the metering blade (not shown) operatively associated with the metering roll 552. The amount of liquid $X_0$ can correspond to that of a thick film of the liquid. At the nip 556, the amount of liquid $X_0$ is split, resulting in an amount of liquid $X_1$, which forms a thinner liquid film, being carried on both the outer surface 560 of the donor roll 554 and the outer surface 553 of the metering roll 552 after nip 556. At the nip 592, the amount of liquid $X_1$ is split, resulting in an amount of liquid $X_2$ being carried on both the outer surface 591 of the liquid reducing roll 590 and the outer surface 560 of the donor roll 554 after nip 592. The liquid on the outer surface 591 is metered by metering blade 594. An amount of liquid $X_6$ is metered off of the outer surface 591 by the blade 594. This metered-off liquid can be returned to a receptacle of the liquid supply system, treated (e.g., filtered) and re-used in the liquid supply system 550. After the blade 594, an amount of liquid $X_5$ is carried on the outer surface 591 to the nip 592. At the nip 564, the amount of liquid $X_2$ carried on the outer surface 560 is split, resulting in an amount of liquid $X_3$ being carried on both the fusing surface 504 of the fuser roll 502 and on the outer surface 560 of the donor roll 554 after nip 564. At the nip 510 between the fusing surface 504 and the pressure roll 506, the amount of liquid $X_3$ carried on the fusing surface 504 is split, resulting in an amount of liquid $X_4$ being carried on both the fusing surface 504 medium and on medium after nip 510.

The metering roll 552, donor roll 554 and fuser roll 502 of the liquid supply system 550 have an inside paper path and an outside paper path, as in the roll arrangement shown in FIG. 4. Based on the assumptions for oil splitting and oil loss in the liquid supply system 550, for the inside paper path of the rolls, $X_1$, $X_2$, $X_3$, $X_4$, $X_5$ and $X_6$ have the values with respect to $X_0$ set forth in Equations (9) to (14).

$$X_1=[3(1+b)/2(2+3b)]\cdot X_0, \quad (9)$$

$$X_2=[3/2(2+3b)]\cdot X_0, \quad (10)$$

$$X_3=[1/(2+3b)]\cdot X_0, \quad (11)$$

$$X_4=[1/2(2+3b)]\cdot X_0, \quad (12)$$

$$X_5=[3(1-b)/2(2+3b)]\cdot X_0, \text{ and} \quad (13)$$

$$X_6=[b/2(2+3b)]\cdot X_0. \quad (14)$$

In equations (9) to (14), "b" is the efficiency of blade 594 operatively associated with the liquid reducing roll 590. The efficiency, b, is the ratio of the amount of liquid removed from the outer surface 591 of liquid reducing roll 590 to the amount of liquid incident to the blade 594, i.e., $b=X_6/X_2$. The amount of liquid, $X_5$, that remains on the liquid reducing roll 590 after passing the blade 594 is given by: $X_5=X_2\cdot(1-b)$. Accordingly, when blade 594 is 100% efficient (i.e., b=1) at removing liquid from the liquid reducing roll 590, no liquid will remain on the roll past blade 594 (i.e., $X_5=0$). When blade 594 is completely inefficient, (i.e., b=0), no liquid will be removed from the liquid reducing roll 590 by blade 594 (i.e., $X_5=X_2$).

The efficiency of the blade 594 can be varied by changing the load applied by the blade 594 to the liquid reducing roll 590. Blade loading parameters can be addressable and adjustable to achieve a desired amount of liquid removal from the liquid reducing roll, and consequently control the amount of liquid placed on media by the fusing surface.

Based on the same assumptions for oil splitting and oil loss in the liquid supply system 550 made for the inside paper path, for the outside paper path of the rolls, $X_1$, $X_2$, $X_3$, $X_4$, $X_5$ and $X_6$ have the following values with respect to $X_0$:

$$X_1=[(1+b)/(1+2b)]\cdot X_0, \quad (15)$$

$$X_2=[1/(1+2b)]\cdot X_0, \quad (16)$$

$$X_3=[1/(1+2b)]\cdot X_0, \quad (17)$$

$$X_4=[1/(1+2b)]\cdot X_0, \quad (18)$$

$$X_5=[(1-b)/(1+2b)]\cdot X_0, \text{ and} \quad (19)$$

$$X_6=[b/(1+2b)]\cdot X_0. \quad (20)$$

Equations (9) to (20) demonstrate the range of liquid reduction that can be achieved for inside and outside paper paths using the liquid supply system 550 including at least one liquid reducing roll 590 and blade 594.

As indicated by equation (18), the addition of at least one liquid reducing roll 590 and blade 594 in the liquid supply system 550 can also reduce the amount, $X_4$, of liquid release agent applied to the fusing surface 504 in the outside paper path (OPP) area. Consequently, the liquid supply system 550 can reduce the amount of unused (excess) liquid that builds up on the rolls of the liquid supply system 550 and on the fusing surface 504 in the outside paper path area. When the size (width) of media that is being printed in the printing apparatus is changed (increased) without cycling out, such excess liquid on the rolls and fusing surface affects image quality in the previous outside paper path area of the print. Reducing the amount, $X_2$, of liquid on the outer surface 560 of the donor roll 554 results in a lower OPP/IPP liquid ratio on the fusing surface 504 during a print run. Lowering this ratio reduces the magnitude of image quality defects that may be caused by a high liquid rate.

In embodiments, the liquid supply system 550 can be used to supply release agent to the fusing surface 504 for fusing images on media having widths ranging from about 7.2 inches to about 14.3 inches, for example.

Comparing equations (12) and (18), the ratio, $R_{OPP/IPP}$, of the amount of liquid on the fusing surface 504 (and placed on media) for the outside paper path to that of the inside paper path after passing the nip 510 can be varied by changing the efficiency, b, of blade 594, as follows:

$$\text{At } b=0,\ R_{OPP/IPP}=4, \text{ and} \quad (21)$$

$$\text{At } b=1,\ R_{OPP/IPP}=10/3. \quad (22)$$

Equations (21) and (22) indicate that the liquid reducing roll 590 and blade 594 allow the ratio, $R_{OPP/IPP}$ to be selectively tuned by controlling the blade efficiency, b, depending on the desired relative liquid application rates at the outside and inside paper paths.

Comparing equation (3) for the amount of liquid, $X_3$, placed on media using a liquid supply system without a liquid reducing roll and associated metering blade at the inside paper path to equation (12) for the amount of liquid, $X_4$, placed on media using liquid supply system 550 (including liquid reducing roll 590 and associated blade 594) at the inside paper path gives:

$$X_4/X_3=2/(2+3b) \quad (23)$$

Figure 6:
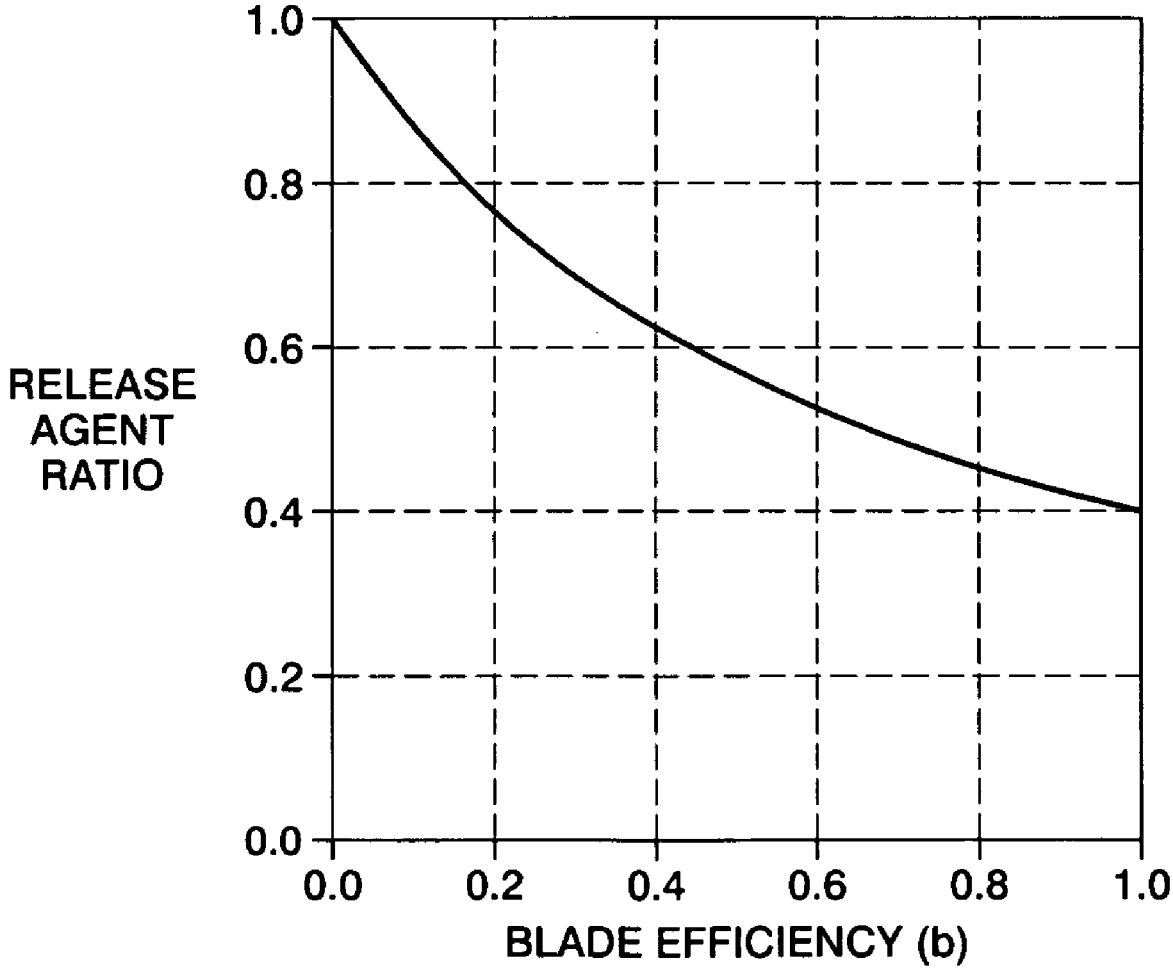
FIG. 6 shows a curve of release agent ratio (for release agent placed on media for different supply systems) versus blade efficiency.

FIG. 6 graphically illustrates the relationship between the ratio $X_4/X_3$ and the efficiency, b, of the blade 594. As shown, the value of the ratio $X_4/X_3$ can vary from 1 (i.e., $X_4=X_3$ at b=0) to 0.4 (i.e., $X_4/X_3=2/5$ at b=1). Accordingly, the amount of liquid release agent placed on media using the liquid supply system 550 can be as low as 40% (at b=1) of the amount of liquid release agent placed on media using a liquid supply system without a liquid reducing roll and associated metering blade, depending on the value of efficiency, b, of the blade 594. The liquid reducing roll 590 and blade 594 allow the application rate of liquid to media at the nip 510 to be tunable depending on the desired application rate.

By selectively reducing the amount of release agent placed on media using a liquid reducing roll 590 and blade 594, instead of attempting to tune the metering blade operatively associated with metering roll 552 or the metering roll construction, various difficulties associated with such tuning are avoided. For example, tuning the blade by making the blade edge sharper, increasing the blade tip loading, and/or making the outer surface of the metering roll smoother can each result in an increased frequency of streaks forming on media. As the ratio between blade defect size and nominal liquid release agent film thickness approaches 1:1 and greater, manufacturing defects in the blade edge increase the severity of the defect. In addition, sensitivity to dirt (e.g., non-visual offset, paper debris) increases as the release agent film thickness is decreased. Such debris can lodge under the blade contact point and cause increased streaking and servicing in printing apparatuses. The liquid supply system 550 can be used to form thick films of liquid release agent on the metering roll 552, and these thick films can avoid contamination by paper fibers and toner during printing.

In embodiments, the liquid supply system 550 can be used to place an amount of liquid release agent ranging from about 2 ml/sheet to about 100 ml/sheet on media. The amount of release agent that is applied to media can be varied depending, e.g., on the desired fuser roll or belt service life and performance, the type of post-printing operations performed on media printed with the fuser, and other factors.

Embodiments of the liquid supply system 550 can also be used in printing apparatuses other than xerographic printing apparatuses. For example, embodiments of the liquid supply system 550 can be used in solid ink-jet printing apparatuses.

Embodiments of the liquid supply system 550 can be used in fusers that have different configurations than the fuser 500. For example, embodiments of the liquid supply system 550 can be used in fusers that include a fusing belt having a fusing surface for heating media at the nip formed with the pressure roll to fuse toner on the media.

It will be appreciated that various ones of the above-disclosed and other features and functions, or alternatives thereof, may be desirably combined into many other different systems or applications. Also, various presently unforeseen or unanticipated alternatives, modifications, variations or improvements therein that may be subsequently made by those skilled in the art, are also intended to be encompassed by the following claims.

What is claimed is:

1. A liquid supply system for supplying liquid to a fusing surface of a fuser member, comprising:

a metering roll having a first outer surface;

a donor roll having a second outer surface disposed adjacent the first outer surface to define a first nip between the first and second outer surfaces;

a liquid reducing roll having a third outer surface disposed adjacent the second outer surface to define a second nip between the second and third outer surfaces; and a blade that removes liquid from the third outer surface, wherein the blade has an efficiency, b, which is the ratio of an amount of liquid removed from the third outer surface by the blade to an amount of liquid incident to the blade, and b is selectively variable from about 0 to about 1, wherein:

the metering roll conveys the liquid from the first outer surface to the second outer surface;

the donor roll is disposed adjacent the fuser member such that the second outer surface and the fusing surface define a third nip, and to convey the liquid from the second outer surface to the fusing surface; and the liquid reducing roll removes a portion of the liquid from the second outer surface before the liquid is conveyed to the fusing surface.

2. The liquid supply system of claim 1, wherein:

the second outer surface has a length; and the third outer surface contacts substantially the entire length of the second outer surface.

3. The liquid supply system of claim 1, wherein the third outer surface is selectively movable into and out of engagement with the second outer surface to vary an amount of pressure applied by the third outer surface to the second outer surface.

4. A printing apparatus comprising a liquid supply system according to claim 1.

5. A fuser, comprising:

a metering roll having a first outer surface;

a sump containing a supply of a liquid, the first outer surface contacting the liquid in the sump;

a donor roll having a second outer surface disposed adjacent the first outer surface to define a first nip between the first and second outer surfaces;

a liquid reducing roll having a third outer surface disposed adjacent the second outer surface to define a second nip between the second and third outer surfaces;

a fuser member having a fusing surface disposed adjacent the second outer surface to define a third nip between the second outer surface and the fusing surface;

a pressure roll having a fourth outer surface disposed adjacent the fusing surface to define a fourth nip between the fusing surface and the fourth outer surface; and a blade that removes liquid from the third outer surface, wherein the blade has an efficiency, b, which is the ratio of an amount of liquid removed from the third outer surface by the blade to an amount of liquid incident to the blade, and b is selectively variable from about 0 to about 1, wherein:

the metering roll conveys the liquid from the first outer surface to the second outer surface;

the donor roll conveys the liquid from the second outer surface to the fusing surface; and the liquid reducing roll removes a portion of the liquid from the second outer surface before the liquid is conveyed to the surface.

6. The fuser of claim 5, wherein the fuser member is a fuser roll.

7. The fuser of claim 5, further comprising heating rolls for heating the fusing surface.

8. The fuser of claim 5, wherein:

the third outer surface is composed of an elastomeric material;

the second outer surface has a length;

the third outer surface contacts substantially the entire length of the second outer surface; and the third outer surface is selectively movable into and out of engagement with the second outer surface to vary an amount of pressure applied by the third outer surface to the second outer surface.

9. A method of supplying liquid to a fusing surface of a fusing member, comprising:

conveying the liquid from a first outer surface of a metering roll to a second surface of a donor roll adjacent the first surface;

conveying the liquid from the second outer surface to the fusing surface of the fusing member adjacent the second outer surface; and removing a portion of the liquid from the second outer surface with a liquid reducing roll having a third outer surface adjacent the second outer surface before the liquid is conveyed to the fusing surface; and removing liquid from the third outer surface using a blade, the blade having an efficiency, b, which is the ratio of an amount of liquid removed from the third outer surface by the blade to an amount of liquid incident to the blade; and varying an amount of pressure applied by the third outer surface to the second outer surface to vary the efficiency, b, of the blade from about 0 to about 1.

10. The method of claim 9, wherein:

the second outer surface has a length; and the third outer surface contacts substantially the entire length of the second outer surface.

11. The method of claim 9, wherein the fusing member is a fuser roll.

12. The method of claim 9, wherein:

the fusing surface has an inboard paper path portion and an outboard paper path portion; and the method further comprises controlling a ratio of an amount of the liquid conveyed to the inboard paper path portion to an amount of the liquid conveyed to the outboard paper path portion.

13. The method of claim 9, wherein:

the fusing surface has an inboard paper path portion and an outboard paper path portion; and the method further comprises controlling an amount of the liquid conveyed to the outboard paper path portion.

* * * * *